United States Patent [19]

Enokido et al.

[11] Patent Number: 4,564,078

[45] Date of Patent: Jan. 14, 1986

[54] APPARATUS FOR STORING FELT PENS FOR AN ELECTRONIC BOARD

[75] Inventors: Shunji Enokido, Yokohama; Hideyuki Kodani, Kawasaki; Hajime Ohta, Yokohama, all of Japan

[73] Assignee: Fujitsu Limited, Kawasaki, Japan

[21] Appl. No.: 571,189

[22] Filed: Jan. 16, 1984

[30] Foreign Application Priority Data

Jan. 18, 1983 [JP] Japan ..... 58-005089[U]
Jan. 31, 1983 [JP] Japan ..... 58-012203[U]
May 9, 1983 [JP] Japan ..... 58-080505

[51] Int. Cl.[4] ..... G08C 21/00
[52] U.S. Cl. ..... 178/18
[58] Field of Search ..... 178/18–20; 346/139 R, 139 C, 49, 46; 340/701, 703, 706, 709; 211/69.1, 69.3, 69.5, 69.8

[56] References Cited

U.S. PATENT DOCUMENTS 4,135,245 1/1979 Kemplin et al. ..... 346/139 R X
4,501,931 2/1985 Ohya et al. ..... 178/18

FOREIGN PATENT DOCUMENTS 0098117 1/1984 European Pat. Off. .
1044198 11/1953 France .
629565 7/1963 France .
1481615 5/1967 France .

*Primary Examiner*—Stafford D. Schreyer
*Attorney, Agent, or Firm*—Staas & Halsey

[57] ABSTRACT

An apparatus for storing unused felt pens for use in an electronic input board system includes a plurality of pen loaders. In systems in which multiple color information is written on the electronic board, colored felt pens are provided and one of these color felt pens is replaceably mounted in a pen holder. In order to prevent drying out of ink, the unused felt pens are sealed with a cap which is positioned within each pen loader. When a felt pen is loaded into the pen holder to write a letter or a graphic pattern of a selected color, a switch detects which felt pen has been selected for loading in the pen holder, and the system identifies the color of the pen. The apparatus maintains the points of unused felt pens airtightly sealed within the cap to protect them against drying out of ink, while allowing a single-handed operation for loading-/unloading a felt pen into/from the pen holder without staining the operator's fingers, clothes, etc. with ink.

23 Claims, 11 Drawing Figures

APPARATUS FOR STORING FELT PENS FOR AN ELECTRONIC BOARD

BACKGROUND OF THE INVENTION

This invention relates to an apparatus for storing input pens for writing letters and/or graphic patterns on a board having a tabulation function.

Recently, so-called tele-conference systems have been put into practical use. In these systems, an electronic input board having a tabulation function (hereinafter referred to as an electronic board) is usually installed at each local site. By use of such electronic boards, conference attendees at remote locations can confer with each other by way of timely hand-written information such as that used in a conference room (e.g., on a blackboard, overhead projector, etc.). Such electronic tabulation boards have been offered under the trademark "GEMINI 100 Electronic Blackboard" sold by AT&T or the trademark "FACOM 2260 OA Board System" sold by Fujitsu, for example.

The principle function of the electronic board is to detect the positional coordinate of a hand-held input instrument, such as a piece of chalk, a pencil or some other special input instrument, when the input instrument contacts the surface of an input board. The coordinates of the contact points are stored or transmitted to a display unit, and the reproduction of the contact points (which form letters or graphic patterns) is displayed on the display unit.

Generally, electronic board systems can be classified into two types, in accordance with the method by which the coordinates of the contact points are detected. One type is a pressure sensing type which detects the contact between a hand-held instrument and an input board by using a pressure sensitive tablet board as the input board. The other type is a magnetic type, wherein the coordinates of the contact points are magnetically detected.

The magnetic type system includes two subtypes: a first in which the electronic board detects signals generated by a hand-held input pen; and a second in which the electronic board generates signals and the hand-held input pen detects the signals.

The essential part of a magnetic type electronic board of the second subtype is illustrated in FIG. 1. The input board includes an electronic board 1 (tabulator of patterns written on the input board) having installed therein a number of coils arranged in the X and Y directions, with the distance between the coils depending upon the desired resolution. The coils are usually fabricated by employing a technology similar to that for fabricating printed circuit boards. The coils include X-coils 2 and Y-coils 3 in accordance with the direction in which the coils are arranged, as shown in FIG. 1. The X-coils 2 and Y-coils 3 are excited individually with electric current, so that the magnetic field generated by the coils varies in dependence upon the position (in the X and Y directions) on the board 1. When a letter 6 (for example "A") is written on the board 1 by use of an input pen 5, a detection coil 4 installed in the input pen 5 detects the magnetic field at the surface of the board 1. Based on the timing or phase of the magnetic field detected by the coil 4, the positional coordinate of input pen 5 on the board 1 is detected. Thus, data representing the letter 6 is input into the system and a corresponding letter 6 is reproduced on a display unit 7 which is installed at a local or remote site.

Color information can also be processed by the electronic board. An example of one color information input system is disclosed in U.S. patent application Ser. No. 507,497, filed June 24, 1983 titled "Color Information Input System for Electronic Board" and assigned to the assignee of the subject application, the disclosure of which is hereby incorporated by reference. In that system, multiple color information is input by using a single input pen consisting of a pen holder and a selected one of plural color felt pens which are replaceably mounted in the pen holder.

FIGS. 2A and 2B are illustrations of a prior art pen holder 8 and a prior art felt pen 15, respectively. Referring to FIG. 2A, the pen holder 8 includes an outer tube 9 made of, for example, a synthetic resin, an inner tube 10 positioned within the outer tube 9, and a detection coil 11 which is coaxially wound around the bottom end region of the inner tube 10. The pen holder 8 further includes a chuck 12 having a tapered hole 12*a*, the open end of which is directed downward and which is positioned adjacent the upper end portion in the inner tube 10. The chuck 12 is positioned so as to be able to move slightly (about 1 to 2 millimeters, for instance) in its axial direction and is biased in a downward position by spiral spring 13, so that the chuck 12 is normally located at its lowest limit position. A switch (e.g., switch 30 in FIG. 2C) is installed above the chuck 12, so that the switch changes to an ON state when the chuck 12 is pressed upward to reach its upper limit position. The switch is connected to a cord 14 which extends through the upper end of the holder 8.

In FIG. 2B, the felt pen 15, which is to be mounted in the pen holder 8 (FIG. 2A), includes a casing 16 which is adaptable to be removably inserted inside the inner tube 10 of FIG. 2A. The felt pen 15 further includes a filler 17 which is, for example, cotton (and which is soaked with ink), and a felt stick 18 mounted in a hole formed in a neck 16*a* of the casing 16. Ink soaked up by the filler 17 penetrates the felt stick 18, and reaches an exposed tip 18*a* of the felt stick 18. At the top end of the casing 16, a casing-head 19 is attached, and the upper portion 19*a* of the casing-head 19 is tapered to fit within the chuck 12 of the holder 8 (FIG. 2A). When a felt pen filled with ink of a desired color is selected and inserted into the pen holder 8 of FIG. 2A, the casing-head 19 is pushed into the tapered hole 12*a* and is held by the chuck 12. In this manner, the felt pen 15 is secured in the pen holder.

When the felt pen 15 is used to write a letter or graphic pattern on the electronic board 1, the tip 18*a* is pressed onto the surface of the board 1, and the felt pen 15 is displaced upwardly in the pen holder 8. As a result, the switch installed in the pen holder 8 is turned on, and positional coordinate signals detected by detection coil 11 are sent to the display unit 7. Referring to FIG. 2C, the switch may include a reed switch 30, (i.e., a magnetically activated switch) secured to the top of the inner tube 10, and a magnetic element 31 secured to the top of chuck 12. When the felt pen 15 is displaced upwardly, the reed switch 30 is activated by the approach of the magnetic element 31.

The felt pens which are not in use (unused felt pens) are stored in an apparatus equipped with caps, and the point of each unused felt pen is inserted in the cap to prevent evaporation of the ink. The caps also help to prevent inadvertent stray marking of fingers, clothes, walls, etc.

This prior art configuration of the input pen, including a demountable felt pen 15, provides advantages in avoiding an increase in system costs and inconvenience due to entangling of cords, both of which will occur if multiple input pens (including multiple pen holders 8) are used.

SUMMARY OF THE INVENTION

It is an object of the present invention to provide an apparatus for storing unused felt pens for an electronic board, which keeps the ink in the felt pens from drying out.

It is another object of the present invention to provide an apparatus for storing unused felt pens, in which it is easy to load or store a felt pen with a one touch operation.

It is still another object of the present invention to provide an apparatus for storing unused felt pens for an electronic board, which is not likely to cause stray marking on the fingers of the operator when a felt pen is loaded or stored.

The above objects are accomplished by providing an individual pen loader for each of the available felt pens. Each pen loader includes a cap which encloses the point of a felt pen in an airtight manner; and a lever which pulls the felt pen away from the cap. Sensors, which are activated in connection with the movement of the levers, and which generate signals indicating which one of the felt pens is taken out from the corresponding pen loader, may be provided.

These together with other objects and advantages, which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 2B:
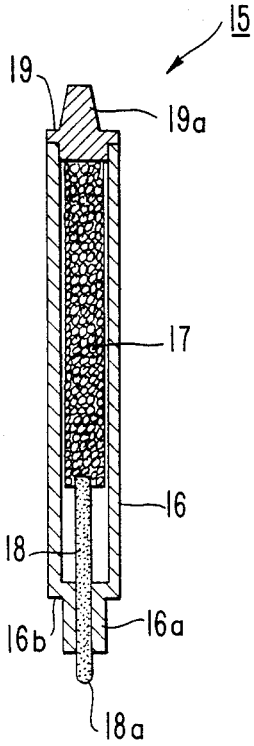
FIG. 2B. (PRIOR ART)
FIG. 2B is a cross-sectional view of a prior art felt pen which is used as part of an input device for an electronic input board system in combination with the pen holder of FIG. 2A.
Figure 2C:
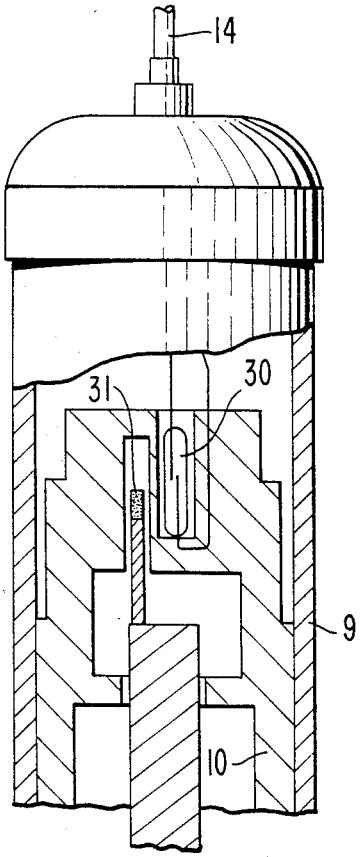
FIG. 2C. (PRIOR ART)
FIG. 2C is a partially cutaway side view of a prior art switch built in the pen holder of FIG. 2A, which signals the electronic board system that the input pen is being used.
Figure 3:
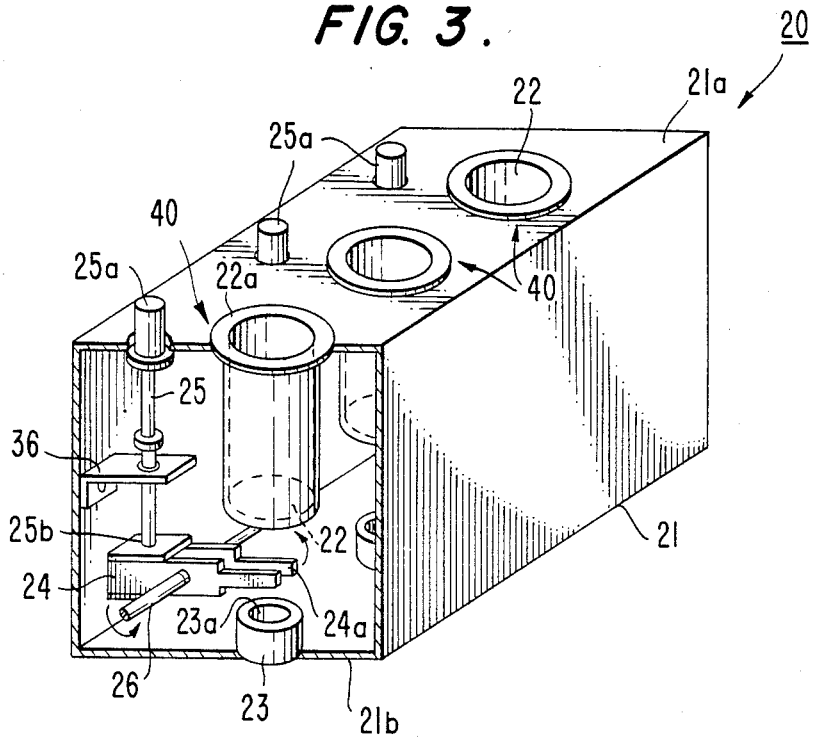
FIG. 3 is a partially cutaway perspective view of an embodiment of the present invention.

FIG. 3 is a partially cutaway perspective view of an embodiment of the present invention. In FIG. 3, 20 is an apparatus for storing marking pens (e.g., felt pen 15 in FIG. 2B). The apparatus 20 includes a rectangular case 21, and a plurality of pen loaders 40 comprising guide sleeves 22, caps 23, levers 24, and rods 25 for operating the levers 24. The number of pen loaders 40 is equal to the number of colors of felt pens which are required (in FIG. 3, three pen loaders 40 are shown).

Figure 1:
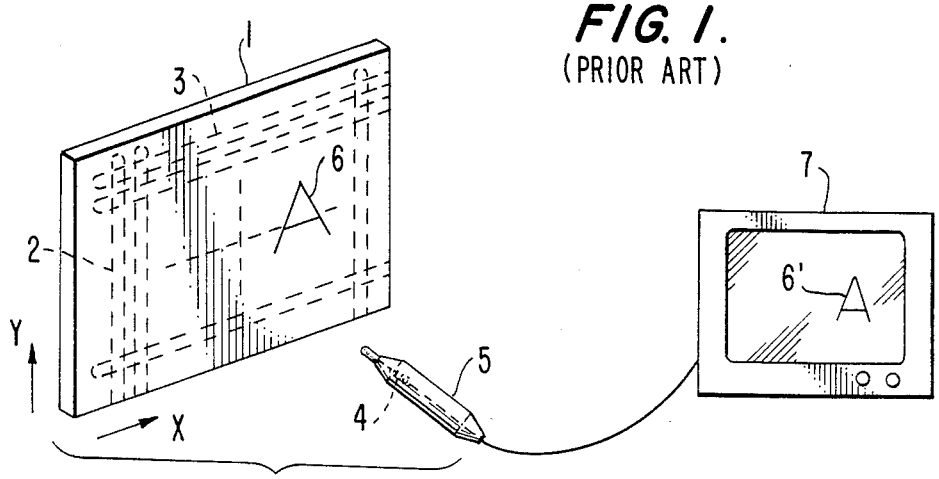
FIG. 1. (PRIOR ART)
FIG. 1 is a schematic view of an essential part of a prior art electronic input board system.
Figure 2A:
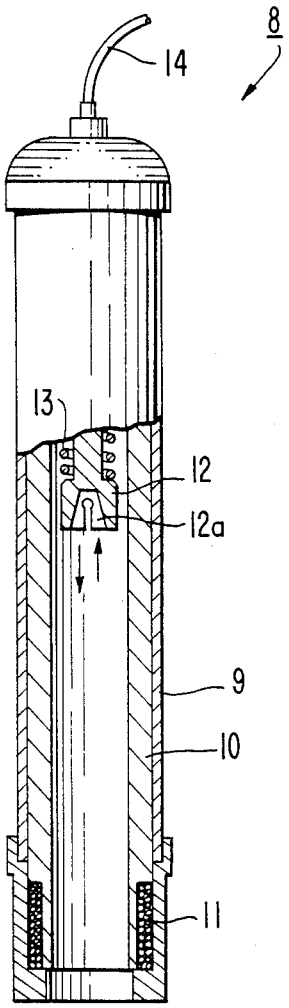
FIG. 2A. (PRIOR ART)
FIG. 2A is a partially cutaway side view of a prior art pen holder, used for an electronic input board system.

Each of the guide sleeves 22 extends into case 21 and has an inner diameter which is slightly larger than the outer diameter of the pen holder 8 of FIG. 2A and a length which is less than that of the pen holder 8. Each guide sleeve 22 has a flange **22*a* which is secured to an upper cover 21*a* of the case 21. On a bottom cover 21*b* of case 21, a cap 23 is positioned for each pen loader 40. A hole 23*a*, having an inner diameter slightly larger than the outer diameter of the neck 16*a* of felt pen 15, (FIG. 2B) is bored in the upper side of cap 23. The hole 23*a* is deep enough to enclose the tip 18*a* of felt pen 15. An O-ring type gasket 27 (see FIG. 4A) is positioned on the inner wall forming hole 23*a*. The gasket 27 has an elasticity and an aperture size selected to fit the neck 16*a* of the felt pen 15 airtightly but detachably. One end 24*a* of each lever 24 is a horizontally branched fork, for example, in order to grasp the neck 16*a* of the felt pen 15. The gap between the branches of the fork is slightly larger than the diameter of the neck 16*a* but less than the diameter of the casing 16. Each lever 24 is mounted pivotally on a horizontal shaft 26. The lever 24 becomes horizontal (i.e., substantially parallel to the bottom cover 21*b* of the case 21) and stays in that position when the end 24*a* is just above the upper face of cap 23**.

Each of the rods 25 extends through a hole in a supporting member 36 which is secured to a side of the case 21, so that each rod 25 can move in its axial direction. A bottom end **25*b* of each rod 25 contacts the upper face of lever 24, and the top 25*a* of the rod 25 extends out of case 21 through upper cover 21*a*. When the top 25*a* of rod 25 is pressed down, the corresponding lever 24 pivots about the shaft 26 and the forked end 24*a* of the lever 24** rotates upwardly.

Figure 4A:
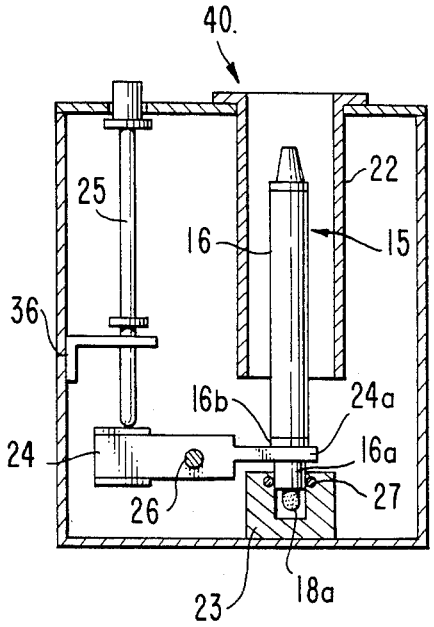
FIG. 4A is a cross-sectional view of FIG. 3, taken along the center portion of one of the pen loaders, showing a felt pen placed in a pen loader and having a cap secured thereto.

FIG. 4A illustrates a felt pen 15 stored in a pen loader 40, either before the felt pen 15 has been loaded in the pen holder 8 or after the felt pen 15 has been unloaded from the pen holder 8. The tip **18*a* of the felt pen 15 is inserted through the hole 23*a* in the cap 23, and neck 16*a* of felt pen 15 is airtightly sealed to the cap 23 due to the O-ring type gasket 27. The stepped portion 16*b* at the interface between the neck 16*a* and the body of the casing 16 of the felt pen 15 contacts the upper face of the forked end 24*a*, so that further travel of the felt pen 15 in the guide sleeve 22 is prevented, and the neck 16*a* is positioned between the branches of the forked end 24*a*. The binding force of the gasket 27 to the neck 16*a* is adjusted to be stronger than the holding force of chuck 12 which holds the casing-head 19 of the felt pen 15 (FIG. 2B). Accordingly, if a felt pen 15 mounted in the pen holder 8, is inserted in a pen loader 40 and engaged by cap 23, the felt pen 15 is left in engagement with the cap 23 when the pen holder 8 is pulled out from the pen loader 40. Consequently, the unused felt pens 15 are always unloaded and stored in the pen loaders 40, and their tips 18***a* are airtightly enclosed by the caps 23, so as to prevent drying out of the tips 18*a* of the felt pens 15.

Figure 4B:
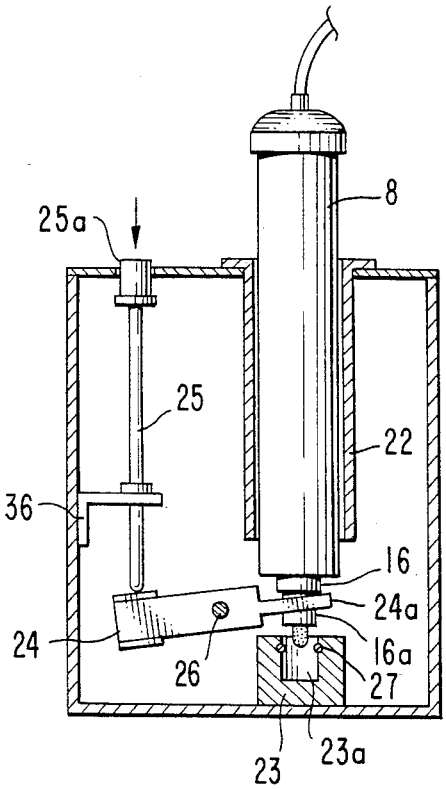
FIG. 4B is a cross-sectional view, similar to FIG. 4A, but showing a felt pen stored in a pen loader, and mounted in the pen holder, just after the felt pen has disengaged the cap.

Loading of a felt pen 15 by pen loader 40 into pen holder 8 is performed in the following manner. Referring to FIGS. 4A and 4B, an empty pen holder 8 (which does not have a felt pen 15 mounted therein) is inserted through the guide sleeve 22 of pen loader 40, until the casing-head 19 (see FIG. 2B) of the felt pen 15 stored in the pen loader 40, is engaged by the tapered hole 12*a* of chuck 12 (see FIG. 2A), and the felt pen 15 is secured to the pen holder 8. When the top 25*a* of the rod 25 corresponding to the pen loader 40 is depressed, the lever 24 pivots about the shaft 26 and the end 24*a* of the lever 24 engages the step 16*b* of the felt pen 15. At this time, the pulling force applied to the neck 16*a* by lever 24 is stronger than the friction of the gasket 27, so that the felt pen 15 is disengaged from the cap 23 and moved upward through guide sleeve 22 together with pen holder 8. Thus, pen holder 8 is loaded with felt pen 15 when it is pulled out of pen loader 40, and is ready for use.

It is obvious that the shape of the end 24*a* of lever 24 is not required to be a fork, and may instead be a ring, for example, having an aperture which allows neck 16*a* to pass through, but which engages the step 16*b* to lift and uncap the felt pen 15.

Figure 5A:
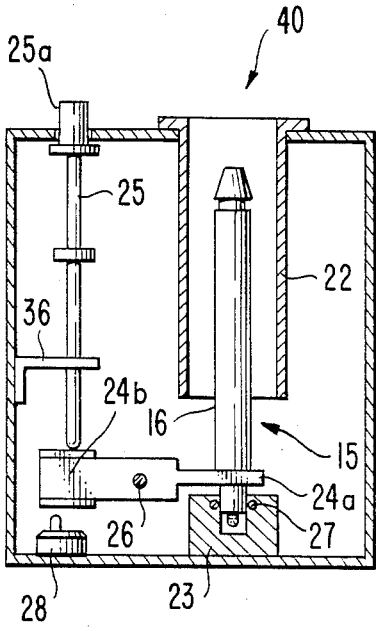
FIG. 5A is a cross-sectional view of another embodiment of the present invention, which includes a sensor for detecting the use of a felt pen.
Figure 5B:
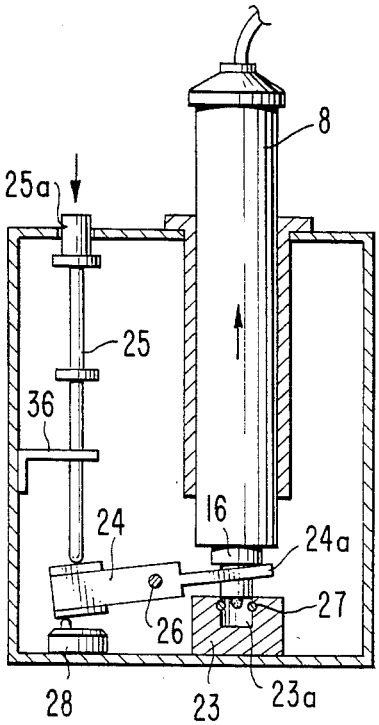
FIG. 5B is a cross-sectional view, similar to FIG. 5A, illustrating how the sensor of FIG. 5A is activated when a felt pen is disengaged from its cap.

FIGS. 5A and 5B are cross-sectional views of another embodiment of the present invention. In order to reproduce letters or graphic patterns in the same color as they are written on the electronic board, it is necessary to send color information to the electronic board system. This can be accomplished by identifying the pen loader 40 from which the particular felt pen 15 is removed. Each colored felt pen 15 is assigned to be stored in a specified pen loader 40. The use of sensors to detect a felt pen removed from a particular pen loader is disclosed in the above-mentioned U.S. patent application Ser. No. 507,497. In the disclosure of that application, the absence of a felt pen in a pen loader is detected by a photosensor comprising a light source and a photodetector, both of which are installed to face each other through apertures diametrically formed on the wall of the guide sleeve of each pen loader, for example. In the present invention, a sensor detects displacement of a lever which is pivoted to pull a felt pen away from its cap. This device provides an advantage in that there is no need to form a light guide aperture in the wall of the guide sleeve.

Referring to the embodiments of FIGS. 5A and 5B a sensor 28 is added to the embodiments of FIGS. 4A and 4B, respectively, for each lever 24. Each sensor 28 may be, for example, a micro-switch positioned adjacent to, but not in contact with, the corresponding lever 24, when the lever 24 is in the horizontal position substantially parallel to the bottom cover 21*b* of the case 21. That is, each sensor 28 is OFF when the corresponding pen loader 40 stores a felt pen 15. When the top 25*a* of a rod 25 is depressed (as shown in FIG. 5B) lever 24 pivots about the shaft 26 and the felt pen 15 is disengaged from the cap 23. At the same time, an end 24*b* of lever 24 contacts the sensor 28 and activates it. Thus, when a felt pen 15 is loaded in pen holder 8 and removed from pen loader 40, the particular felt pen 15 which is being loaded is identified and identification data is transmitted to the electronic board system.

In order to simplify system control it is preferable that sensor 28 be continuously activated while pen loader 40 is empty. For this purpose, shaft 26 is positioned at a point spaced apart from the equilibrium point of lever 24; in particular, shaft 26 is positioned closer to the end 24*a* than to the end 24*b* of lever 24. Accordingly, lever 24 pivots so that the end 24*a* tends to move away from the upper face of cap 23 when the neck 16*a* of the felt pen 15 is not engaging the cap 23. As a result, sensor 28 is continuously activated by the end 24*b*. When a felt pen 15 is returned to the pen loader 40 and capped by cap 23 (as shown in FIG. 5A), lever 24 is repositioned at its horizontal level, and sensor 28 is turned OFF.

Figure 6A:
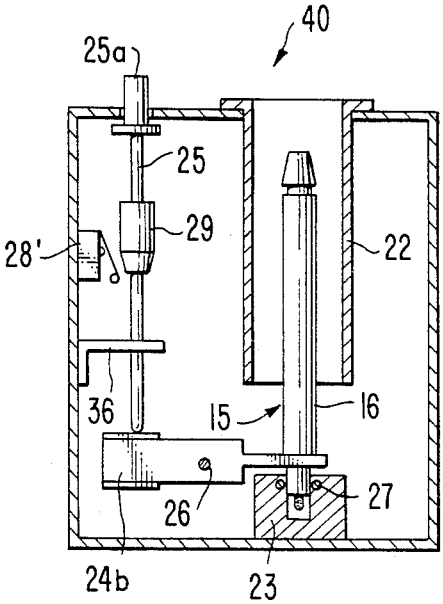
FIG. 6A is a cross-sectional view, similar to FIG. 5A, illustrating another embodiment of a sensing mechanism for the pen loaders of the present invention.
Figure 6B:
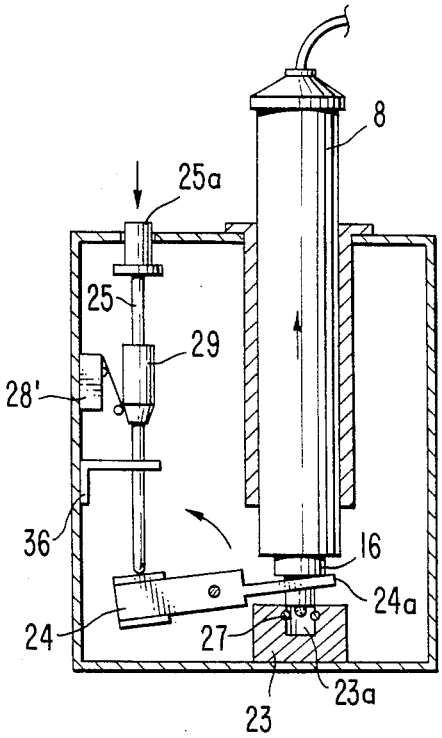
FIG. 6B is a cross-sectional view, similar to FIG. 6A, showing the sensor of FIG. 6A in its activated position.

Many variations of the above embodiments will be apparent to those skilled in the art. For example, in FIGS. 5A and 5B, each sensor 28 is positioned to face the corresponding lever 24; however, the sensor 28 may be positioned to directly contact the corresponding felt pen 15 when the pen 15 is stored in pen loader 40. Alternatively, a sensor 28' may be positioned to contact an actuating cam 29, as illustrated in FIGS. 6A and 6B. In these figures, the cam 29 is secured to the rod 25, and the sensor 28' is positioned adjacent the cam 29 (e.g., the sensor 28' is mounted on a side cover of the case 21). When felt pen 15 is held in cap 23 and lever 24 is in the horizontal position, the cam 29 does not contact the sensor 28' (as shown in FIG. 6A). When the felt pen 15 is loaded in pen holder 8 and the top end 25*a* of rod 25 is depressed as shown in FIG. 6B, the cam 29 contacts and activates the sensor 28' The sensor 28' continues to be activated until felt pen 15 is recapped with cap 23 and lever 24 returns to the horizontal position.

The sensors 28 and 28' need not be micro-switches; e.g., photo-sensors or magnetically activated sensors, etc., which detect movement of the lever 24 or the presence of a felt pen 15 engaging the cap 23, may be used.

It is obvious that the mechanism for holding a felt pen 15 in the pen holder 8 is not limited to the combination of a chuck 12 and a tapered casing-head 19 (see FIGS. 2A and 2B), and other arrangements may be used. Furthermore, each pen loader 40 may be assigned not only with respect to ink color but with respect to other characteristics of the felt pens 15. For example, if felt pens 15 having tips 18*a* of different thickness are stored in the pen loaders 40, they can be distinguished by the corresponding sensors in the same manner as above, and letters or graphic patterns having lines of different thickness can be reproduced on a display unit, in the same line thickness ratios as on the electronic board.

It is clear from the above description of the preferred embodiments that the apparatus of the present invention can prevent the ink in unused felt pens for an electronic input board from drying out, while allowing single-hand one touch operation for loading/unloading the felt pen to/from the pen holder, without staining fingers, clothes, furniture, etc. with stray ink markings.

The many features and advantages of the invention are apparent from the detailed specification and thus it is intended by the accompanying claims to cover all such features and advantages of the system which fall within the true spirit and scope of the invention. Further, since numerous modifications and changes will readily occur to those skilled in the art, it is not desired to limit the invention to the exact instruction and operation shown and described, and accordingly all suitable modifications and equivalents may be resorted to, falling within the scope of the invention.

What is claimed is:

1. An apparatus for storing felt pens, having tips, used for marking an electronic board in an electronic board input system, comprising:

a case having a top and bottom;

a plurality of pen loaders positioned in said case, each of said plurality of pen loaders for storing a respective one of the felt pens when it is not being used and for loading a felt pen when it is to be used, each of said pen loaders comprising:

a cap positioned on the bottom of said case, said cap being adapted to enclose the tip of the corresponding felt pen in an airtight manner;

a guide sleeve extending into said case; and a lever pivotally mounted to said case, said lever having a forked shaped end which is positioned between said cap and said guide sleeve, said forked shaped end of said lever lifting the felt pen in the corresponding one of said plurality of pen loaders in a direction towards the top of said case when a force is applied to the opposite end of said lever; and sensors respectively positioned adjacent the lever for each of said plurality of pen loaders, each of said sensors being activated in dependence upon movement of the corresponding lever to generate a signal indicating that the corresponding felt pen is in use.

2. An apparatus as set forth in claim 1, wherein each of the felt pens is adapted to be received by a pen holder and wherein said guide sleeve has a tubular form, the diameter of said guide sleeve being sufficient to receive the pen holder.

3. An apparatus as set forth in claim 1, wherein said cap has an O-ring type gasket fitted therein.

4. An apparatus as set forth in claim 3, wherein each of the felt pens has a neck portion with a diameter, and wherein the inner diameter of said O-ring type gasket is less than the diameter of the neck portion of each of the felt pens.

5. An apparatus as set forth in claim 1, wherein each of said sensors comprises a micro-switch.

6. An apparatus as set forth in claim 1, wherein each of said sensors comprises a light source and photodetector pair.

7. An apparatus as set forth in claim 1, wherein each of said sensors comprises a magnetically activated switch.

8. An apparatus for storing marking pens, used in combination with a pen holder, for marking an electronic board in an electronic board input system, each of the marking pens having a neck portion and a step portion, said apparatus comprising:

a case having top and bottom covers; and pen loaders positioned in said case, each of said pen loaders for storing one of the marking pens when it is not being used, each of said pen loaders comprising:

a guide sleeve extending through the top cover of said case into said case, said guide sleeve capable of receiving the corresponding one of the marking pens and the pen holder;

a cap, positioned on the bottom cover of said case opposite said guide sleeve, for engaging and capping the corresponding marking pen;

a lever pivotally mounted to said case, said lever having a first end with a forked shape positioned between said cap and said guide sleeve, said lever having a second end; and means for actuating said lever so that the first end of said lever causes the marking pen to disengage said cap, so that when said lever is pivoted by said actuating means, the forked shaped first end of said lever engages the step portion of the marking pen, thereby disengaging the marking pen from said cap.

9. An apparatus as set forth in claim 8, wherein said cap has an O-ring type gasket fitted therein and wherein the inner diameter of said O-ring type gasket is less than the diameter of the neck portion of the marking pen.

10. An apparatus as set forth in claim 9, further comprising:

sensors, respectively positioned adjacent each of said pen loaders, for detecting when a marking pen is removed from the corresponding one of said pen loaders.

11. An apparatus as set forth in claim 10, wherein each of said sensors is mounted on said case adjacent the corresponding lever so as to be activated in dependence upon the movement of said corresponding lever.

12. An apparatus as set forth in claim 10, wherein each of said sensors comprises a micro-switch.

13. An apparatus as set forth in claim 10, wherein each of said sensors comprises a light source and photodetector pair.

14. An apparatus as set forth in claim 10, wherein each of said sensors comprises a magnetically activated switch.

15. An apparatus as set forth in claim 8, further comprising:

sensors, respectively positioned adjacent each of said pen loaders, for detecting when one of the marking pens is removed from the corresponding one of said pen loaders 16. An apparatus as set forth in claim 15, wherein each of said sensors is mounted on said case adjacent the corresponding lever so as to be activated in dependence upon the movement of said corresponding lever.

17. An apparatus as set forth in claim 15, wherein each of said sensors comprises a micro-switch.

18. An apparatus as set forth in claim 15, wherein each of said sensors comprises a light source and photodetector pair.

19. An apparatus as set forth in claim 15, wherein each of said sensors comprises a magnetically activated switch.

20. An apparatus for storing felt pens, having tips, used for marking an electronic board in an electronic board input system, comprising:

a case having a top and bottom; and a plurality of pen loaders positioned in said case, each of said plurality of pen loaders for storing a respective one of the felt pens when it is not being used and for loading a felt pen when it is to be used, each of said pen loaders comprising:

a cap positioned on the bottom of said case, said cap being adapted to enclose the tip of the corresponding felt pen in an airtight manner;

a guide sleeve extending into said case; and a lever pivotally mounted to said case, said lever having a forked shaped end which is positioned between said cap and said guide sleeve, said forked shaped end of said lever lifting the felt pen in the corresponding one of said plurality of pen loaders in a direction towards the top of said case when the force is applied to the opposite end of said lever.

21. An apparatus as set forth in claim 20, wherein each of the felt pens is adapted to be received by a pen holder and wherein said guide sleeve has a tubular form, the diameter of said guide sleeve being sufficient to receive the pen holder.

22. An apparatus as set forth in claim 21, wherein said cap has an O-ring type gasket fitted therein.

23. An apparatus as set forth in claim 22, wherein each of the felt pens has a neck portion with a diameter, and wherein the inner diameter of said O-ring type gasket is less than the diameter of the neck portion of each of the felt pens.

* * * * *